United States Patent [19]

Crowe

[11] 4,216,827

[45] Aug. 12, 1980

[54] FLUID PRESSURE SET AND RELEASED WELL PACKER APPARATUS

[76] Inventor: Talmadge L. Crowe, P.O. Box 3048, Houston, Tex. 77001

[21] Appl. No.: 907,121

[22] Filed: May 18, 1978

[51] Int. Cl.[2] ..... E21B 33/126; E21B 33/128

[52] U.S. Cl. ..... 166/120; 166/182

[58] Field of Search ..... 166/120, 182, 212

[56] References Cited

U.S. PATENT DOCUMENTS

| | | | |
|---|---|---|---|
| 3,054,450 | 9/1962 | Baker | 166/120 |
| 3,122,205 | 2/1964 | Brown et al. | 166/120 |
| 3,142,338 | 7/1964 | Brown | 166/120 |
| 3,215,205 | 11/1965 | Sizer | 166/120 |
| 3,282,342 | 11/1966 | Mott | 166/120 |
| 3,785,436 | 1/1974 | Davis, Jr. | 166/120 |
| 3,924,678 | 12/1975 | Ahlstone | 166/120 |
| 4,044,826 | 8/1977 | Croue | 166/120 |

*Primary Examiner*—James A. Leppink

*Attorney, Agent, or Firm*—Subkow and Kriegel

[57] ABSTRACT

A double grip well bore packer run into a well casing on a pipe string has actuator means responsive to hydrostatic or applied fluid pressure to set anchor slips and deform a packing into engagement with the casing, and the setting force is locked into the packing. Pressure differential from below the packer actuates hold-down elements into engagement with the casing. A shearable member is sheared by a shear piston which is normally pressure balanced but rendered unbalanced when a releasing tool is seated in the packer and operated so that fluid pressure can act on the shear piston and release the packer for retrieval from the well casing.

20 Claims, 10 Drawing Figures

FLUID PRESSURE SET AND RELEASED WELL PACKER APPARATUS

Figure 1A:
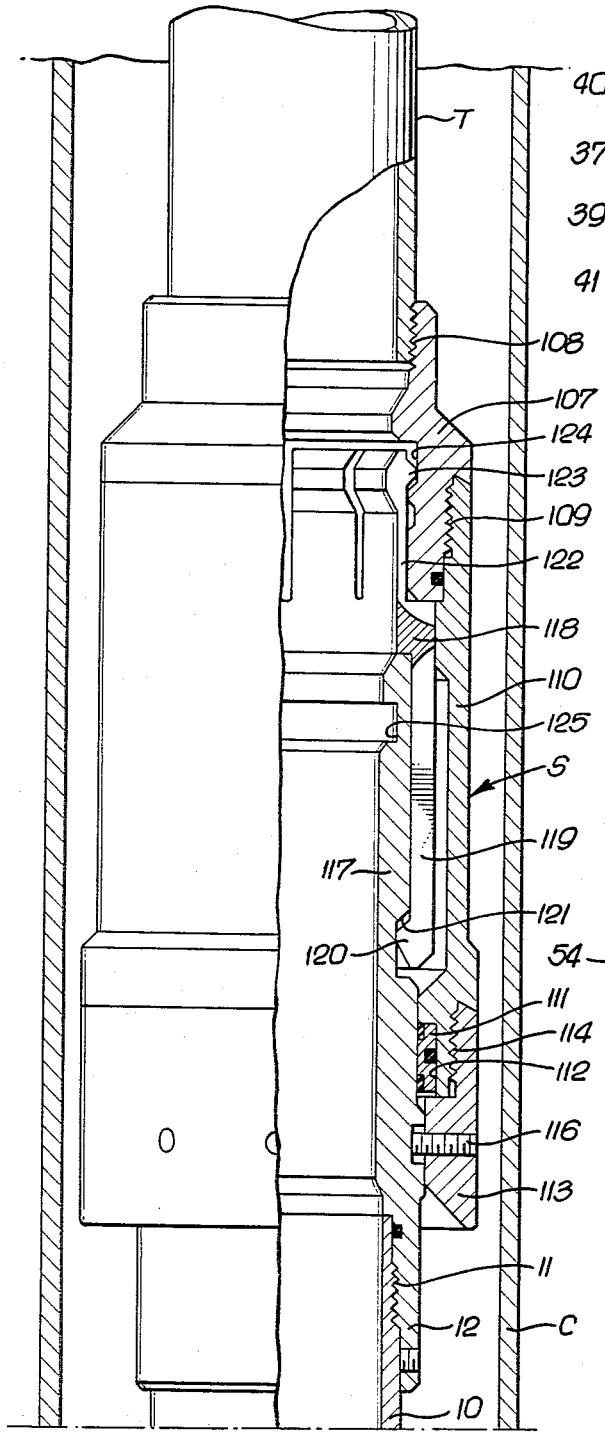

This invention relates to well bore or casing packers of the type adapted to be set and anchored in a well bore casing by fluid pressure, hydrostatic and/or applied, to form a seal between a pipe string and the casing, without manipulation of the pipe string.

Fluid pressure set well packers are well-known, including, as examples, those shown and described in U.S. Pat. No. 3,112,796, granted Dec. 3, 1963, to Myers, U.S. Pat. No. 3,131,769, granted May 5, 1964, to de Rochemont, and also including the Model "FH" Double-Grip Hydrostatic Single-String Packer, Product No. 781-08 of Baker Packers, Houston, Tex.

Double Holding packers such as that disclosed in U.S. Pat. No. 3,112,796 and the Model "FH" packer identified above can be run into a well in a tubing or pipe string, set and anchored by fluid pressure and released for retrieval by pulling on the running pipe string or tubing to shear a member which acts to retain the packer set or locked in engagement with the casing.

The present invention provides such a packer with means responsive to fluid pressure to release the packer for retrieval from the well.

The packer of the invention is a versatile, single string packer, well suited for use as a single packer, as the lower packer in multiple packer hookups using dual or triple string packers, or as an upper packer in selective single string packer hookups, where displacing fluid through the tubing is desired after the well is flanged up, or where well conditions may prohibit use of mechanically set packers. The packer does not require tubing manipulation.

In accomplishing the foregoing, a packer is provided which has expansible slip and packing means initially held against expansion, until fluid pressure releases the mechanism for operation. Once set and packed off the pack off force is maintained by means mechanically locking the initial setting force into the resilient packing elements, and reduction of downhole pressure or tubing contraction does not diminish the holding action, but increased downhole pressure or tubing expansion causes an increase in the pack-off force. The pack-off is not dependent upon trapped fluid in the setting mechanism.

To release the packer, a releasing tool is lowered into the packer to enable operation of releasing means responsive to hydrostatic or applied pressure, whereby the tubing can be pulled to cause release of the packing and the slips. The packer can also be released by taking a strain on the tubing.

More particularly the packer of the invention has a tubular mandrel connectible in a tubing string and having anchor slips and resilient packing means normally retracted to allow running of the packer, or a number of them, on the tubing string. Setting means for expanding the slips and the packing means include an outer mandrel and housing structure on the tubular mandrel and defining therebetween an atmospheric chamber and an operating pressure chamber. Releasable means are provided to hold the mandrels and the housing against relative longitudinal movement until the releasable means is pressurized through the tubing to cause release. Upon release of the releasable means, hydrostatic pressure acts on the outer mandrel structure to shift it relative to the housing and the inner mandrel to set the slips and deform the packing outwardly into sealing engagement with the casing. A ratcheting lock or one way clutch permits relative movement of the mandrels to set the packer and locks the setting force into the resilient packing. The inner mandrel and the housing also define therebetween a releasing piston chamber, in which a release piston is pressure balanced. Upon landing a release tool in the inner packer mandrel and operating the release tool to bleed the release piston chamber at one side of the release piston to an atmospheric chamber in the release tool, hydrostatic or applied tubing pressure shifts the release piston to cause release of the inner mandrel for longitudinal upward movement through the outer mandrel, enabling relaxation of the packing and retraction of the slips. The outer mandrel structure also has holddown elements responsive to differential pressure to engage the casing and prevent upward movement of the packer until the inner mandrel is moved upwardly in the outer mandrel structure, following operation of the release piston.

The release piston shears a shear member which can also be sheared by a straight upward pull on the tubing string, in the absence of the release tool or if the release tool should fail to function.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Figure 1B:
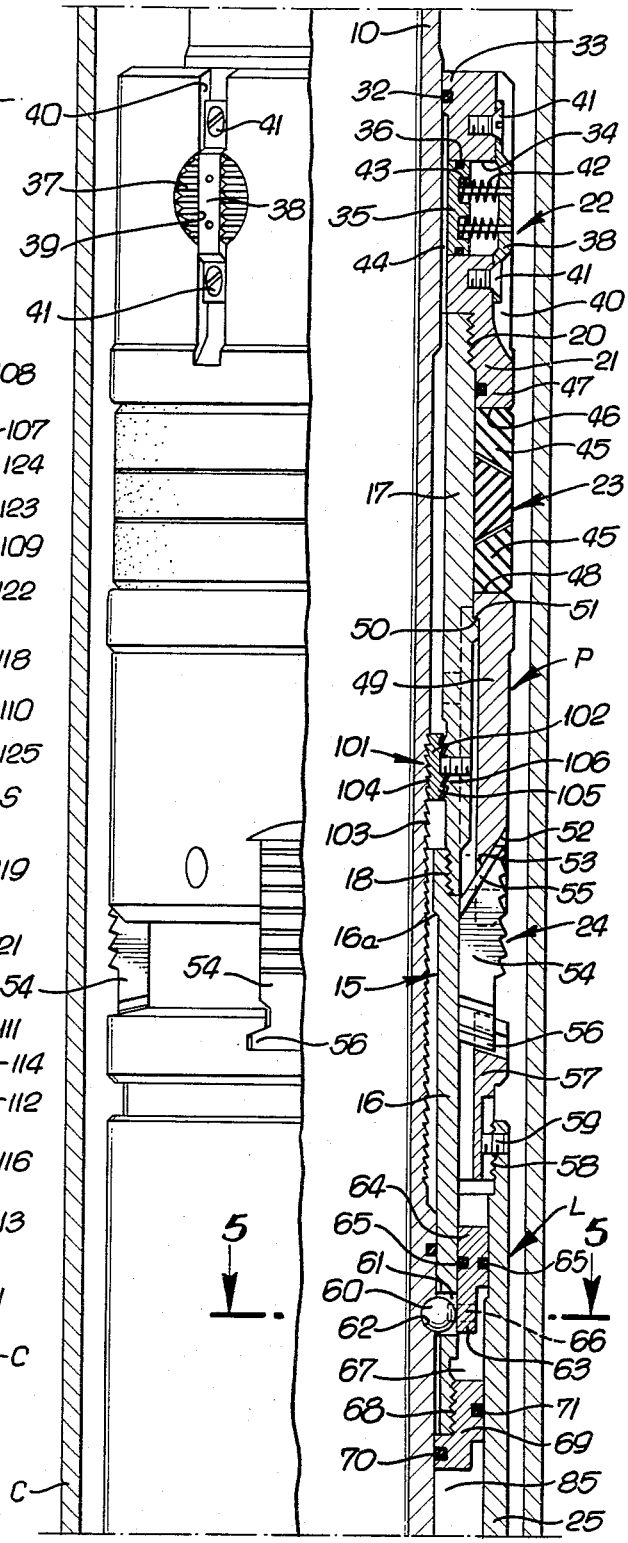
Figure 1C:
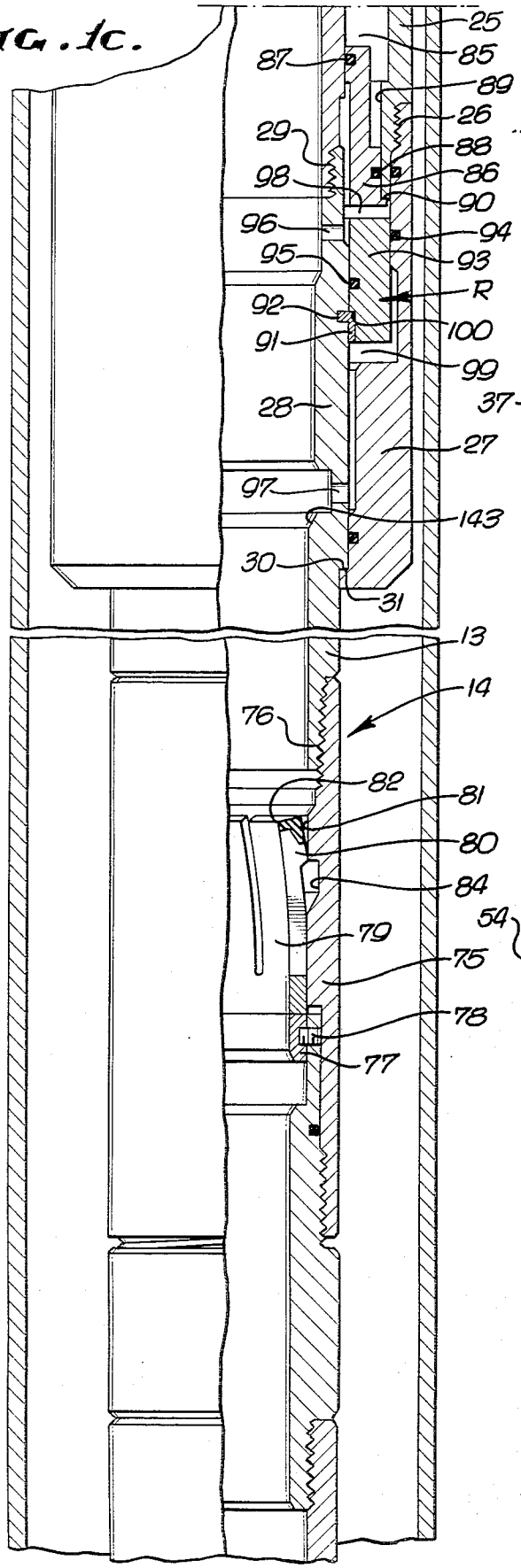

Referring to the drawings:

FIGS. 1*a* through 1*c*, together, constitute a view partly in elevation and partly in longitudinal section showing packer apparatus in accordance with the invention in running in condition in a well casing, FIGS. 1*b* and 1*c* being successive downward continuations of FIG. 1*a;*

Figure 2A:
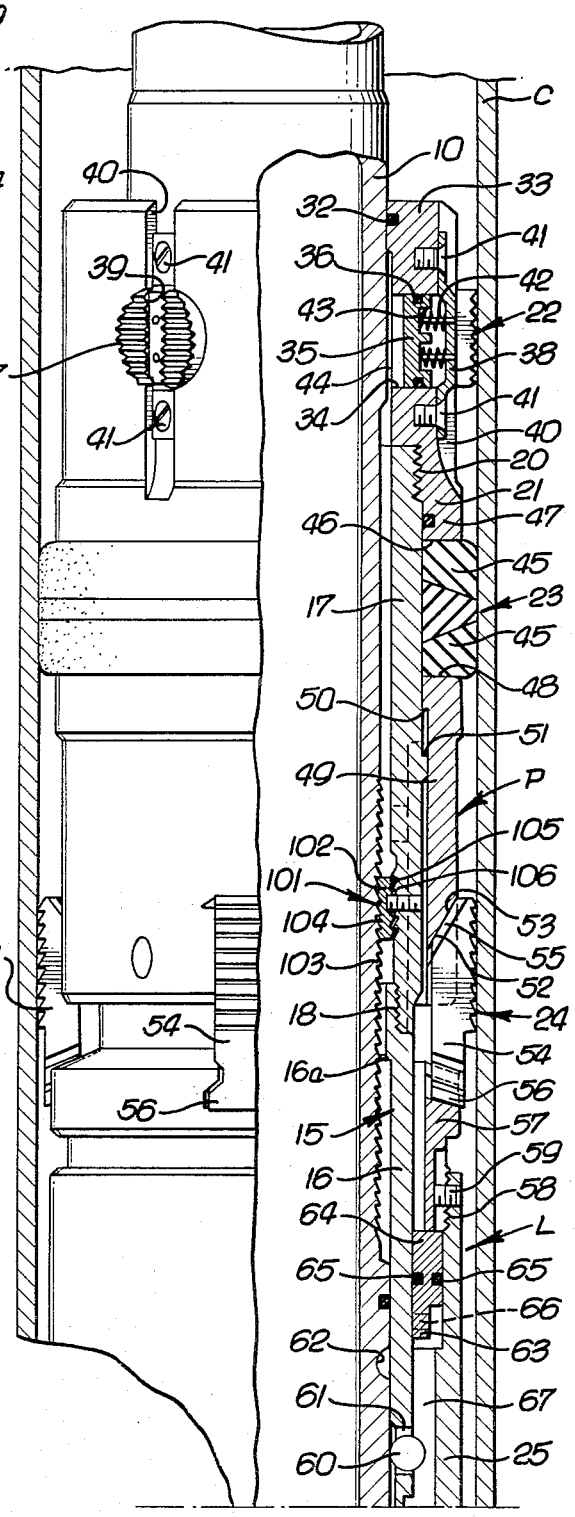
Figure 3B:
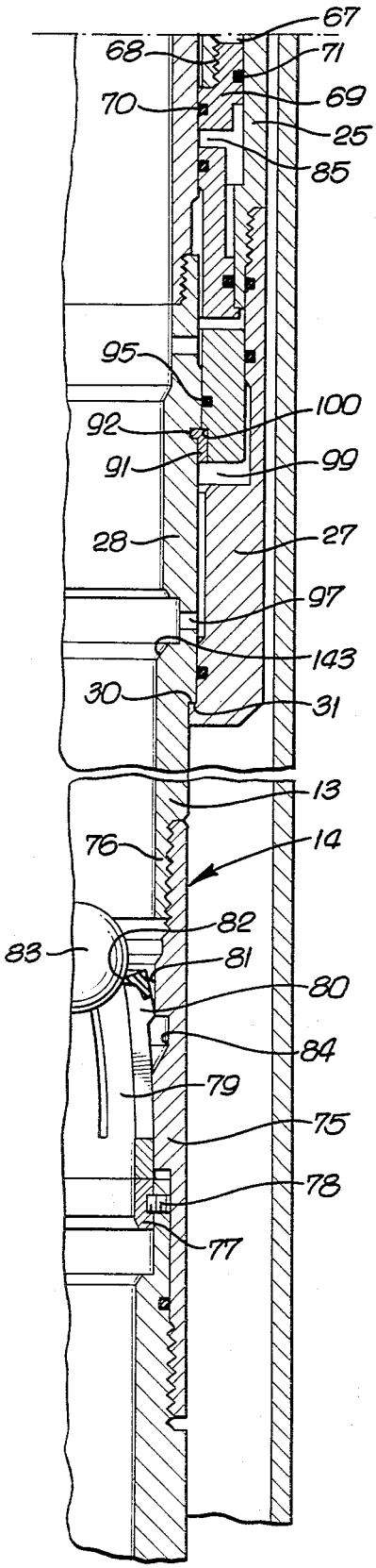
Figure 3A:
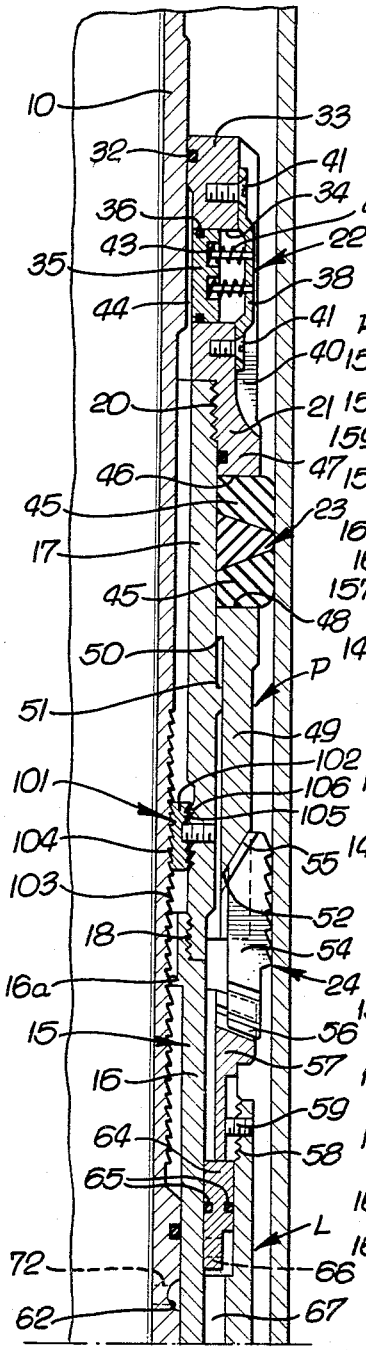
Figure 3B:
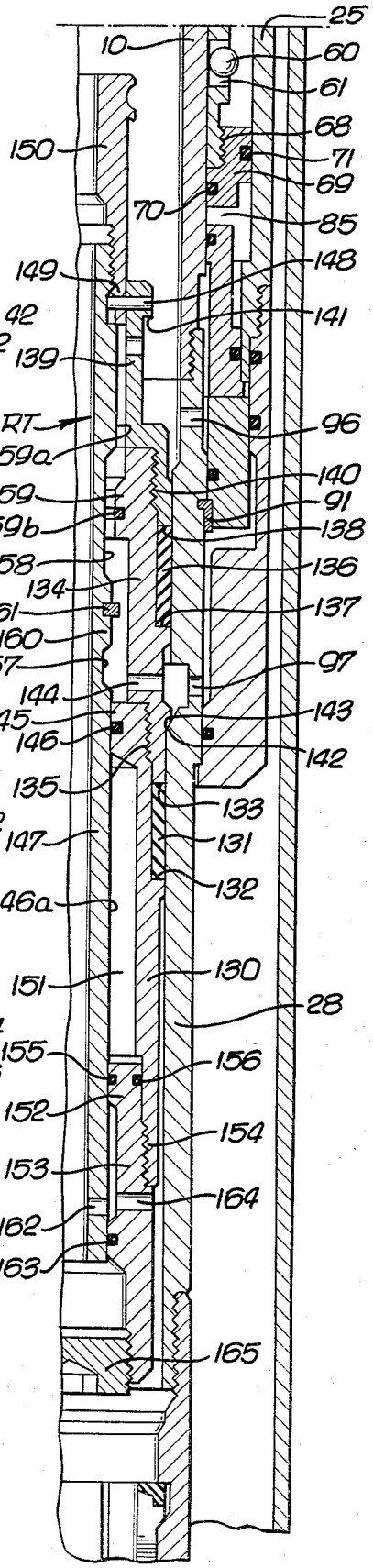
Figure 4A:
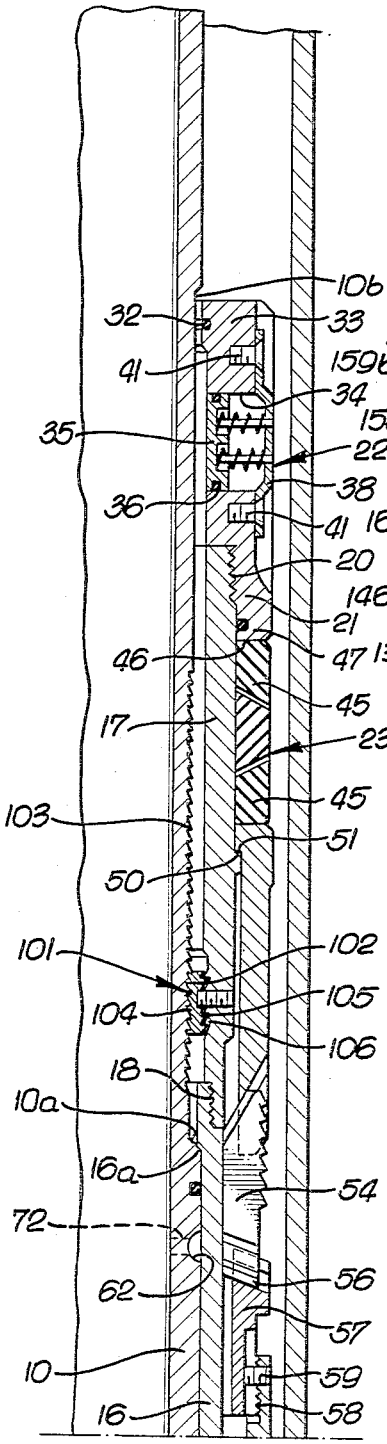
Figure 4B:
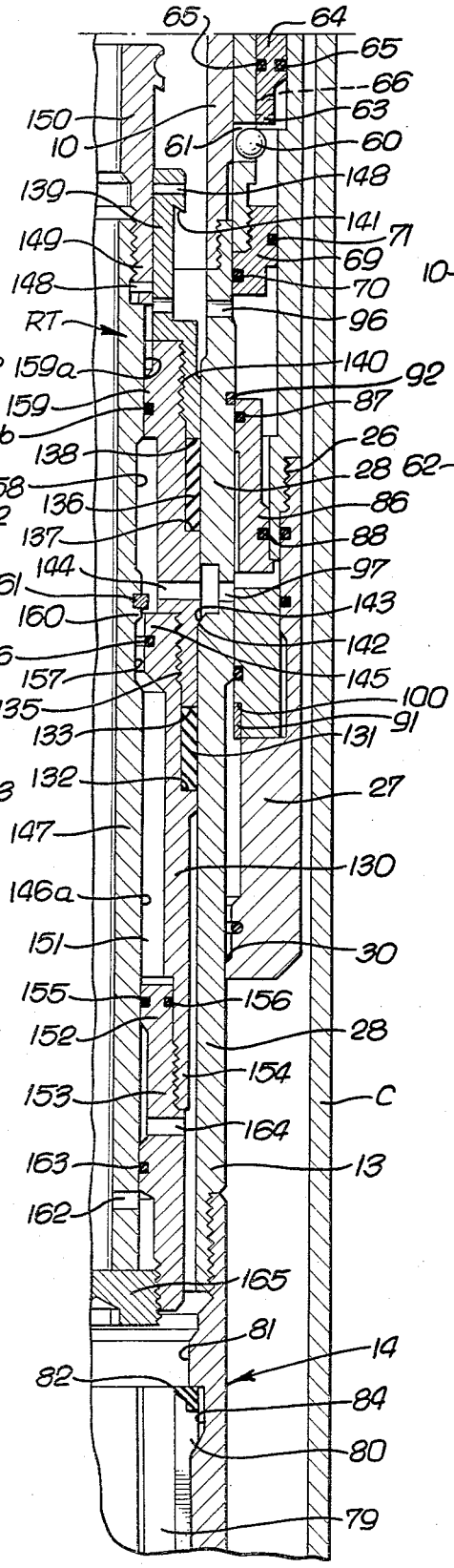
Figure 5:
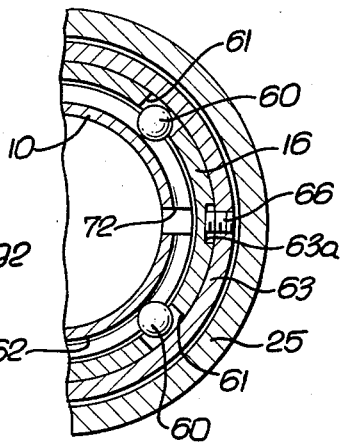

FIGS. 2*a* and 2*b*, together, constitute a view corresponding to FIGS. 1*b* and 1*c*, but showing the packer set by fluid pressure in anchoring and sealing engagement in the casing, and with the lower portion of the apparatus shown in longitudinal quarter section;

FIGS. 3*a* and 3*b*, together, constitute a longitudinal quarter section of the packer apparatus of FIGS. 2*a* and 2*b*, and showing a releasing tool landed in the packer prior to operation of the releasing tool;

FIGS. 4*a* and 4*b*, together, constitute a longitudinal quarter section corresponding to FIGS. 3*a* and 3*b*, but showing the releasing tool in a releasing condition and the packer apparatus released from engagement with the casing;

FIG. 5 is a fragmentary transverse section, as taken on the line 5—5 of FIG. 1*b*.

As seen in the drawings, referring first to FIGS. 1*a* through 1*c*, a double-grip, hydrostatic pressure set and hydrostatic pressure released packer P is connected by an on-off sealing connector S in a running in string of pipe or tubing T, by which the packer is adapted to be lowered from the top of a well to a selected location in a well casing C. The packer may be the only packer in the tubing string T or it may be incorporated in a plural packer set up, say, as the lower packer in a multiple string packer hookup or in a plural packer single tubing string.

The packer is adaptable to such a variety of installations inasmuch as it is pressure set and pressure released without requiring tubing string manipulation.

An elongated inner mandrel or body 10 extends through the packer and has an upper threaded end 11 engaged in the lower end 12 of the on-off sealing connector S, to be later described. At its lower end 13, the mandrel is threadedly connected with a pressure setting sub 14, also to be later described.

Disposed about the inner mandrel or body 10 is an outer mandrel structure 15, including a lower, connector mandrel section 16 and an upper, packing mandrel section 17 joined together at a threaded joint 18 at which is a downwardly facing internal shoulder 16*a*. At its upper end, the packing mandrel 17 is threadedly engaged at 20 in a head 21 of hold-down means 22, below which is resiliently deformable packing means 23 adapted to be axially and circumferentially deformed outwardly into sealing engagement in the casing C, between the hold-down head 21 and lower, anchor slip means 24, when the packer is set, as will be later described.

Below the slip means 24 and telescopically disposed about the connector mandrel section 16 is a tubular housing 25 which is threadedly connected at 26 (FIG. 1*c*) to a lower cylinder member or head 27 slidably engaged with a releasing tool receptacle 28 which forms a part of the inner body structure, the receptacle being threaded at 29 to the lower end portion of the mandrel 10 and having the threaded connection 30 with the pressure sub 14.

At the lower end of the head section 27 is an upwardly facing, internal shoulder 30 engaged with a downwardly facing external shoulder 31 on the receptacle 28, so that the housing 25 cannot move upwardly relative to the mandrel 10. On the other hand the upper hold-down head 21 cannot move downwardly on the body 10, since the outer mandrel structure 15 is releasably connected to the inner body by releasable latch means L (FIG. 1*b*). The packer assembly is therefore maintained in a stretched out condition during running.

The hold-down means 22 is of the fluid pressure operated type, preferably as more particularly disclosed in the above-identified U.S. Pat. No. 3,131,769. As shown, the hold-down has an internal seal ring 32 between the mandrel 10 and the upper end 33 of the head 21. A plurality of radial bores 34 in the head 21 below the seal 32 have pistons or anchor buttons 35 reciprocable in the bores 34 and having side or piston rings 36 sealingly engaged therein. These pistons or buttons have teeth or wickers 37 on their outer ends engageable with the casing C, upon outward movement of the buttons, to anchor the packer P against upward movement in the borehole, after the packer is set and in the presence of differential fluid pressure from below the packer.

Each button anchor element 35 is appropriately oriented with its wickers or teeth 37 disposed normal to the axis of the cylinder 34 by an orienting and retainer bar 38 extending through a longitudinal slot 39 in each element opening through its exterior, the retainer bar also extending into upper and lower grooves 40 in the body on opposite sides of the anchor element. The piston retainer 38 is suitably secured to the body 21, as by use of upper and lower screws 41. The retainer bar also acts as a seat for one or a plurality of springs 42, which may be helical compression springs, mounted in the longitudinal slot 39, the other ends of which engage the retainer bar, and the inner ends of which are disposed in sockets 43 in the anchor element in engagement with an inner face of the latter. As disclosed in the drawings, two longitudinally spaced springs 42 are mounted in each piston anchor or gripping element 35.

The springs 42 urge the anchor elements towards their retracted position. When sufficient pressure is developed in the annular space 44 between the body 10 and the head 21 to overcome the force of the springs, the anchor elements 35 are urged outwardly to engage their teeth with the wall of the well casing C. When such pressure is relieved, the springs 42 return the button anchor elements to their fully retracted position.

The packing means 23 comprises a plurality of resiliently deformable, elastomeric rings 45 disposed about the packing mandrel 17 between the lower end shoulder 46 of a skirt 47 of the hold-down head 21 and an upwardly facing shoulder 48 of a tubular expander body 49 forming part of the anchor means 24. This expander body 49 has an internal shoulder 50 facing downwardly and seating on an upwardly facing outer shoulder 51 on the mandrel section 17. At its lower end, the expander member 49 has a downwardly and inwardly inclined expander or cone surface 52 cooperative with opposed downwardly and inwardly inclined end surfaces 53 of anchor slip elements 54. These slip elements 54 have a dove-tailed, sliding connection 55 with the cone and oppositely inclined T-head connections 56 with the upper end of a slip ring 57 which is threaded at 58 into the upper end of the lower housing 25. A lock screw 59 secures the threaded connection 58.

As previously indicated, the outer mandrel structure 15 is held in an upper position, during running, with the anchor slip means retracted, by the releasable latch means L shown in FIGS. 1*b* and 5. This latch means includes a latch element or elements in the form of a number of circumferentially spaced balls 60 bridging the interface between the inner mandrel 10 and the connector mandrel section 16 in a radial opening 61 in the mandrel section 16 and engaged in an arcuate or semi-spherical seat 62 in the outer periphery of the inner mandrel 10. The balls 60 are retained in the latching position of FIG. 1*b* by a skirt 63 of a latch piston 64 of annular form disposed between the inner cylindrical wall of the housing 25 and the outer cylindrical wall of the connector mandrel 16. Suitable side ring seals 65 are provided on the piston 64 slidably engaged with the cylindrical walls of the housing and connector mandrel. Shear screws 66 are threaded through the latch piston skirt 63 at a selected number of circumferentially spaced locations and extend into slots 63a in the connector mandrel to releasably retain the piston in the position of FIG. 1*b* and thereby releasably hold the connector mandrel 16 against downward movement on the inner body or mandrel 10, since the latch balls 60 are held in the seat 62.

Below the latch piston 64 is a piston chamber 67, defined between the opposed, respective inner cylindrical wall and outer cylindrical wall of the housing 25 and the body 10. Provided on the lower end of the connector mandrel 16, as by a threaded connection 68, is an annular piston 69 having inner and outer side ring seals 70 and 71 slidably engaging the body and the housing cylinder surfaces. Fluid is admissible to the piston chamber 67, between the pistons 64 and 69, through a suitable number of radial ports 72 which communicate through the body 10, between the bore therethrough and the piston chamber 67 via the ball openings 61 in the connector mandrel 16.

Thus, it is now apparent that the latch means L can be released by applying through the tubing T and mandrel 10, when the lower end of the mandrel is closed off, sufficient fluid pressure to cause an upward force on the latch piston 64 which will shear the screws 66, move the piston upwardly and allow the balls 60 to move outwardly from their seat 62. In order to enable the increase in pressure in the tubing, the pressure sub 14, or other means for temporarily blanking the tubing below the ports 72 are provided.

As seen in FIGS. 1*c* and 2*b*, the pressure sub 14 includes a housing 75 connected at 76 below the packer assembly. Within the body 75 is a support ring 77, secured in place by shear means 78 to maintain in an upper position a plurality of circumferentially spaced flexible fingers 79. In their upper positions, outwardly projecting lugs 80 at the tops of the fingers engage with an inner body wall 81 and hold the fingers flexed inwardly so that their upper ends combine to form a ball seat 82 adapted to be closed by a ball 83 which can be introduced into the tubing, at the top of the well, when setting of the packer is desired. Shear screws 78 are selected which will shear after the packer is set and anchored, and the fingers then move downwardly, to the position of FIG. 4*b* allowing the lugs 81 to move outwardly into an annular groove 84 below the inner wall 81, the ball then passing downwardly through the sub. Such pressure subs are well known, and other means, also well known, may be employed to allow pressurization of the packer in the piston chamber 67 by pressure applied through the tubing. For example, in some applications where it is advantageous to displace the tubing after the well is flanged up, a differential displacing valve structure may be installed below the packers, the valve structure may be installed below the packers, the valve being opened by pressurizing the tubing, with insufficient pressure to set the packer. After displacing fluid from the tubing, a ball is dropped to close the valve and set the packer. Such a differential valve is the subject of U.S. Pat. No. 3,306,365, granted Feb. 28, 1967 (Model "C" Differential Displacing Valve of Baker Packers, Houston, Tex.).

Below the piston 69, between the housing 25 and the inner body or mandrel 10 (FIGS. 1*b* and 1*c*) is an atmospheric or low pressure chamber 85 defined by the piston 69 on the connector mandrel 16 and a lower piston 86.

This lower piston 86 has an upper and inner side ring seal 87 slidably engaged with the cylindrical outer surface of the inner body or mandrel 10 and a lower and outer side ring seal 88 engaged within an internal bore 89 provided in the lower end of the housing at its connection with the lower head 27. A shoulder 90 is provided at the lower end of the piston 86 and engages the lower end of the housing 25 to limit upward movement of the lower piston 86.

The release means R, as seen in FIG. 1*c*, includes shearable means, such as a shear ring 91 having an internal flange 92 engaged in a companion groove within the outer periphery of the release body section 28. A release piston 93 is provided between the opposed walls of the lower head member 27 and the release body 28, a side ring seal 94 being provided between the outer periphery of the annular piston 93 and the inner cylindrical surface of the lower head 27, and an inner side ring 95 being provided between the inner periphery of the annular piston 93 and the outer cylindrical surface of the release body section 28. Axially spaced upper and lower ports 96 and 97 are provided in the release body section 28 leading to the annular space 98 above the release piston 93 and to the annular space 99 below the release piston 93, respectively. Thus, it will be recognized that under the conditions shown in FIG. 1*c*, the annular piston 93, which has equal end areas exposed to fluid pressure in the upper and lower annular spaces 98 and 99, is pressure balanced and exerts no shearing force on the shear ring 92 which has its body section disposed within a circumferentially extended groove in the inner periphery of the piston 93, the piston having a downwardly facing shoulder 100, adapted, as will be later described, to shear the ring 91 when the packer is being released.

As previously indicated, means are provided which are operable when the packer is set to lock the pack-off force into the resilient packing elements 45. Such means generally designated 101 (FIG. 1*b*) comprises one-way ratchet means, including a resiliently expansible and contractable split-lock ring 102 disposed between the inner mandrel or body 10 and the outer mandrel structure 15, and more specifically between the body 10 and the packing mandrel section 17. Cooengageable between the body lock-ring 102 and the exterior of the body or mandrel 10 are threads or ribs 103 on the body and internal companion threads or ribs 104 within the body lock-ring 102. These threads or ribs are relatively fine and essentially provide roughened contact surfaces which enable the body lock-ring 102 to move downwardly along the body or inner mandrel 10. Return movement of the body lock-ring upwardly along the mandrel 10 is prevented by companion external buttress type threads or ribs 105 on the lock-ring 102 and internal threads or ribs 106 on the interior of the packing mandrel 17, which provide transversely extended abutment surfaces preventing upward movement of the ring 102 with respect to the packing mandrel 17, and downwardly and inwardly inclined wedge surfaces which forcibly urge the split lock-ring 102 circumferentially inwardly into locking engagement between the ribs or threads 102 and 103, to prevent upward movement of the packing mandrel 17 with respect to the inner mandrel or body 10. Such a body locking ring structure, per se, is well-known in the well bore packer field, and an example of such a body lock is shown and specifically described in greater detail in U.S. Pat. No. 3,311,171. The significant point in respect of the present application is that the body locking means 101 allows the packing mandrel 17 to move downwardly with respect to the inner mandrel 10 during setting of the packer, and the lock-ring locks the pack-off force into the packing elements 45 when the packer is set, as will be later described.

In use, the packer assembly is made up in the tubing string and preferably connected to the upwardly extending tubing T by means of the seal connector S shown in FIG. 1*a*. This on-off seal connector S allows the tubing to be released from the packer without requiring manipulation of the tubing string in a rotative direction.

In general, the seal connector S comprises a top sub 107 threadedly connected at 108 to the tubing string T and having a threaded and sealed joint 109 with an external tubular housing 110 carrying at its lower end an internal sealing ring structure 111 mounted within an annular groove 112 defined between the lower end of the housing and a lower guide shoe 113, which is threadedly connected to the housing at 114 and has one or more shear screws 116 which connect the housing structure to the internal seal mandrel 117, which has the threaded connection 11 with the packer body 10. A collet or locking member 118 is interposed between the housing 110 and the seal mandrel 117 and has a downwardly extended set of relatively strong collet or locking fingers 119 provided with inwardly projecting lower end lugs 120 engageable below an external, downwardly facing shoulder 121 on the sealing mandrel 117. The collet member 118 also has an upwardly extended set of relatively weaker collet or locking fingers 122 provided with outwardly projecting lugs 123 at their upper ends engageable within a locking groove 124 in the connector sub 107. This seal connector is more particularly the subject of the copending application for U.S. Pat. entitled "On-Off Seal Connector With Wireline Release", filed June 19, 1978, Ser. No. 916,719, and is illustrated herein as an example of an advantageous means for connecting the tubing to the packer in such a manner that the tubing can be uncoupled from the packer if desired. Such uncoupling is accomplished by applying tension to the tubing to release the lugs 120 from the engagement beneath the shoulder 121, while a probe is latched into an internal groove 125 within the seal mandrel 117 to prevent release of the relatively resilient lock fingers 122, all as more particularly described in the just mentioned copending application for patent.

The packer assembly P is lowered on the tubing string T to a desired setting location within the well casing, either as a single packer in the tubing string or one of a plurality of packer assemblies P within the tubing string. In the event that a plurality of packers are installed in the tubing string, then the releasable latch means L can be dressed by the shear screws 66, as will be apparent from the following description, to cause the packers to be set in the desired sequence. With the packer in the setting position, for example as seen in FIGS. 1*a* through 1*c*, it is apparent that fluid can be displaced downwardly through the tubing string and through the inner body of the packer. When it is desired that the packer be set, the pressure of fluid within the tubing can be increased by dropping the ball 83 into the tubing string. When the ball lands upon the seat 82 provided by the pressure sub 14, pressure within the tubing can be increased. The tubing pressure finds access to the pressure chamber 67 above the annular setting piston 69, via the ports 72 in the inner mandrel or body 10. Downward movement of the annular piston 69 is prevented by the latch balls 60 engaging in the arcuate seat 62 and being held therein by the latch piston skirt 63, until such time as the pressure within the chamber 67 acting upwardly on the latch piston 64 provides an upward force thereon in excess of the shear value of the shear screws 66 causing them to be sheared and thereby allowing the balls 60 to be automatically disengaged from the annular seat 62. At this point the mandrel structure 15 is caused to move downwardly with respect to the inner body or mandrel 10 under the influence of fluid pressure in the chamber 67 acting downwardly on the annular piston 69 and the pressure of fluid in the annulus acting on the mandrel 16. Pressure in the chamber 67 is a combination of the hydrostatic pressure and the applied pressure utilized to shear the shear screws 66. Downward movement of the mandrel structure 15 relative to the body 10 is permitted by the body lock-ring 102 as it ratchets downwardly over the ribs or threads 103 on the mandrel 10. Fluid pressure in the chamber 67, acts upwardly upon the latch piston 64, which is engaged beneath the lower end of the slip ring 57, as the mandrel structure 15, coupled to the hold-down means 22 moves the packing engaging upper shoulder 46 downwardly towards the upwardly facing shoulder 48 provided by the expander member 49. The setting force is derived from the hydrostatic and applied tubing pressure acting on the differential area between seal rings 65 and 71 and annulus pressure acting on the area of the mandrel 15 between the seal rings 65 and 70. This setting force is transmitted through the packing elements 45 to the expander member 49, thereby wedging the slips 54 outwardly to cause engagement of the teeth thereon within the well casing; then the packing elements 45 are resiliently deformed axially and circumferentially outwardly into sealing and packed-off engagement within the casing C. Thereafter, an increase in the tubing pressure can be applied to the ball 83, causing shearing of the seat-retaining shear screws 78, whereby the resilient fingers can move downwardly to the location at which the upper end lugs 80 thereon clear the internal wall 81 of the sub housing and can move outwardly into the annular groove 84, allowing the ball 83 to pass downwardly through the fingers. The packer is thus firmly set and anchored in the casing, and the force required to effect the pack-off is trapped or locked into the resilient packing elements 45 by virtue of the one-way lock between the body lock-ring 102 and the packing mandrel 17 and the body 10 and by virtue of the shear ring 91 which resists relative upward movement of the body 10. In the event that pressure below the set and anchored packer exceeds the pressure in the annulus above the packer, such pressure finds access between the packing mandrel 17 and the inner mandrel 10 to the hold-down piston chambers 34 and can act upon the hold-down slips or anchors 35 to force them radially outwardly into engagement with the casing to prevent such differential pressure from moving the packer assembly upwardly within the well casing. With the packer in the set condition any downward force applied to the mandrel 10 will be transmitted through the body lock-ring to the packing mandrel, causing the transmission of such force through the packing to the anchor slips. Any upward tension imposed on the tubing T will be transmitted through the mandrel 10 and the shear ring 91 to the housing 25, and thus to the slips 54, following contact of the shear piston 93 with the lower piston 86 which forms the atmospheric chamber 85, as seen in FIG. 3*b*.

Means are provided for releasing the packer from its anchored and set condition in the well casing. As seen in FIGS. 3*a* and 3*b* a releasing tool RT is adapted to be lowered through the running pipe string or tubing T on a suitable wireline running tool (not shown) of a well-known type adapted for connection to the releasing tool and to apply a downward jarring action thereto, as is well-known in connection with wireline well tools.

The releasing tool RT comprises an outer body structure, including an intermediate sealing sleeve 130 having suitable packing means 131 carried thereby between an upwardly facing shoulder 132 on the sleeve 130 and the downwardly facing end 133 of an upper sealing sleeve 134. The upper sealing sleeve is threadedly connected to the lower sealing sleeve by a suitable threaded connection 135 and carries an annular packing 136 between an upwardly facing shoulder 137 and the downwardly facing end 138 of a running and retrieving head member 139. The head 139 is suitably threadedly connected to the upper sealing sleeve at 140 and provides a downwardly facing shoulder 141 adapted for engagement by the usual wireline running and retrieving tool.

In the region of the connection 135 between the two sealing sleeves, the tool has a downwardly facing shoulder 142 adapted to engage the upwardly facing landing shoulder 143 within the release body 28 of the packer assembly, whereby the axially spaced packings 131 and 136 are caused to straddle the ports 97 in the release body 28. Below the packing 136 the sealing sleeve 134 has a number of radial ports 144 which communicate with the body ports 97 above an internal annular sealing flange 145 having an internal side ring seal 146 slidably and sealingly engaged with the external cylindrical surface of an elongated, inner tubular mandrel 147.

Mandrel 147 is connected to the running and retrieving head 139 by suitable shear pins 148, the shear pins 148 also extending through the lower threaded end 149 of an upwardly extended anvil 150, to which the wireline running and jarring tool is adapted to apply downward hammer blows for shearing the shear pins 148 when it is desired to release the packer.

With the releasing tool RT in place, the upper port 96 in the release body section 28 is open to the fluid within the tubing string, and with the releasing tool mandrel 147 in the position of FIG. 3*b*, the releasing piston 93 remains pressure balanced. However, upon downward movement of the mandrel 147 from the position of FIG. 3*b* to the position of FIG. 4*b*, communication is established between the lower port 144 in the sealing sleeve 134, which communicates with the release piston chamber 99 below the release piston, and an atmospheric chamber 151 defined between the lower sealing sleeve 130 and the mandrel 147 below the sealing flange 145. The lower end of the atmospheric chamber 151 is closed by an upwardly extended section 152 of a lower head 153 which is threaded into the sealing sleeve 130, as at 154, and has an inner side ring seal 155 and an outer side ring 156 sealingly engaged with the outer cylindrical surface of the mandrel 147 and within the lower bore of the sealing sleeve 130. When the mandrel 147 is in the upper position, a lower annular groove 157 in the outer periphery of the mandrel is spaced above the sealing flange 145, and an upper annular groove 158 in the outer periphery of the mandrel 147 bridges an upper sealing flange 159 on the upper sealing sleeve 134. Between the grooves 157 and 158 is a land 160 which carries an external pickup ring 161 which projects outwardly for engagement beneath the sealing flange 159, when the releasing tool is being removed from the bore of the release body 28.

In addition, when the releasing tool mandrel 147 is in the upper position, a number of radial ports 162 adjacent to the lower end of the mandrel and above a side ring seal 163 in the lower head 153, communicate with a number of radial ports 164 in the lower head 153, through which communication is established between the inner bore of the mandrel and the tubing string below the packer assembly. As the mandrel 147 is moved downwardly to the position of FIG. 4*b*, the ports 162 permit fluid in tubing below the retrieving tool to by-pass it. As the mandrel 147 moves downwardly towards the closure or stop plug 165 which is threaded into the lower head 153 fluid cannot be trapped in the lower end of the releasing tool as it is being actuated due to the opening through the center of the mandrel.

Referring more particularly to FIG. 4*b*, it will be seen that when the releasing tool mandrel 147 is moved downwardly, following shearing of the shear pins 148, a cylindrical sealing surface 159*a* on the mandrel 147, above the annular groove 158, moves into the sealing flange 159 and is engaged by the resilient side ring seal 159*b* in the flange. The lower cylindrical sealing surface 146*a*, which was initially engaged within the sealing ring 146 of the sealing flange 145, is moved downwardly from sealing engagement with the seal ring 146, and the latter is bridged by the exterial groove 157 in the mandrel 147. The groove 157 accordingly establishes communication between the atmospheric chamber 151, radial ports 144 and radial ports 97 which communicate with the release piston chamber 99. Thus, the pressure from chamber 99 is bled off into the atmospheric chamber 151, while the hydrostatic pressure of fluid in the tubing above the packer assembly is applied to the upper end of the release piston 93 in the chamber 98, via the radial ports 96 in the release body 28. If the hydrostatic pressure of fluid within the tubing string is insufficient to cause downward movement of the shear piston 93 with resultant shearing of the shear ring 91, additional fluid pressure can be applied to the tubing to cause such downward movement of the piston 93 and shearing of the shear ring 91, as illustrated in FIG. 4*b*.

After the shear ring 91 has been sheared, the tubing T can be elevated, so that, as seen in FIGS. 4*a* and 4*b*, the atmospheric chamber 85 communicates with the tubing through port 96, and the setting force is relieved. An external, upwardly facing shoulder 10*a* on the inner mandrel or body 10 engages beneath an internal downwardly facing shoulder 16*a* within the outer mandrel structure 15, and more particularly, at the connection between the connector mandrel 16 and the packing mandrel 17. The body lock ring 102 permits the body 10 to ratchet upwardly through the lock-ring, and upon coengagement of the opposing shoulders 10*a* and 16*a*, the reduced diameter section 10*b* of the body 10 is disposed within the holddown head 21, so that hydrostatic pressure is equalized across the holddown pistons or buttons 35, and the latter are returned to their normally retracted positions by the return springs 42. The outer mandrel structure 15 then moves upwardly with the inner body 10, effecting retraction of the anchor slips 54 and allowing the resilient packing elements 45 to resume their normal condition, so that the packing assembly can be retrieved from the well casing.

From the foregoing, it will be seen that the present invention provides a simple, pressure set and locked casing packer with release means also responsive to fluid pressure, whereby the packer can be advantageously employed in a variety of applications where manipulation of the tubing is not possible or practical.

We claim:

1. A retrievable well casing packer comprising: an elongated tubular body connectable in a running pipe string; normally retracted slip means on said body and expansible into engagement with the casing; resilient packing means deformable into sealing engagement with the casing; setting means shiftable on said body for expanding said slip means and deforming said packing means including means responsive to the pressure of fluid in said body; locking means acting between said body and said setting means and enabling shifting of said setting means with respect to said body and for holding said setting means shifted following engagement of said slip means and said packing means with said casing and holding said packing means resiliently deformed; said body and said setting means having means for retracting said slip means and allowing relaxation of said packing means upon movement of said body longitudinally relative to said setting means; and release means releasable responsive to fluid pressure in said body for holding said body against said movement.

2. A packer as defined in claim 1; including latch means releasable responsive to fluid pressure in said body to prevent said shifting of said setting means.

3. A packer as defined in claim 1; said locking means being ratchet means between said setting means and said body enabling said shifting of said setting means and said movement of said body.

4. A packer as defined in claim 1; including latch means releasable responsive to fluid pressure in said body to prevent said shifting of said setting means; said locking means being ratchet means between said setting means and said body enabling said shifting of said setting means and said movement of said body.

5. A packer as defined in claim 1; said release means including normally pressure balanced piston means, and release tool means engageable in said body and operable to unbalance the pressure on said piston means.

6. A packer as defined in claim 1; said release means including a piston shiftable by the pressure of fluid in said body; and shearable means on said body engageabley by said piston.

7. A packer as defined in claim 1; said release means including a piston shiftable by the pressure of fluid in said body, and shearable means on said body engaging said piston, means initially pressure balancing said piston, and means for unbalancing the pressure on said piston.

8. A packer as defined in claim 1; said release means including a piston shiftable by the pressure of fluid in said body, and shearable means on said body engaging said piston, means initially pressure balancing said piston, and including release tool means engageable in said body and operable to unbalance the pressure on said piston.

9. A packer as defined in claim 1, said release means including a piston, a housing member defining with said body a chamber for said piston, first and second passage means between the interior of said body and said chamber at opposite sides of said piston, shearable means on said body and engaged with said piston.

10. A packer as defined in claim 1; including fluid pressure operated hold-down means including casing gripping elements expansible by the pressure of fluid below said packing means for holding the packer in the casing.

11. A retrievable well casing packer comprising: an elongated tubular body connectable in a running pipestring; normally retracted slip means on said body and expansible into engagement with the casing; resilient packing means deformable into sealing engagement with the casing; setting means shiftable on said body for expanding said slip means and deforming said packing means including means responsive to the pressure of fluid in said body; locking means for holding said setting means shifted; said body and said setting means having means for retracting said slip means and allowing relaxation of said packing means upon movement of said body longitudinally relative to said setting means; and release means releasable responsive to fluid pressure in said body for holding said body against said movement; said release means including a piston, a housing member defining with said body a chamber for said piston, first and second passage means between the interior of said body and said chamber at opposite sides of said piston, shearable means on said body and engaged with said piston, and releasing means in said body providing an atmospheric chamber and including a member shiftable between one position with said first and second passage means communicating with the interior of said body and another position connecting one of said passage means with said atmospheric chamber.

12. A packer as defined in claim 10; said releasing means being removably disposed in said body and having means connectable with a running tool.

13. A packer as defined in claim 11; said setting means including a housing and a piston defining with said body an atmospheric chamber, said body having passage means communicating between the interior of said body and the side of said piston opposite said atmospheric chamber.

14. A packer as defined in claim 13; and including latch means releasable by pressure from said body initially holding said setting means against movement relative to said body.

15. A packer as defined in claim 13; and including latch means releasable by pressure from said body initially holding said setting means against movement relative to said body, said latch means comprising a plurality of circumferentially spaced elements carried by said setting means, said body having a seat for said elements, piston means carried by said setting means and engaged with said elements to hold said elements in said seat, and shearable means initially preventing movement of said piston means to a position releasing said elements from said seat.

16. A retrievable well casing packer comprising: an elongated, tubular inner body; having axially spaced first, second and third passage means opening to the exterior of said body; an outer mandrel structure longitudinally shiftable on said body, locking means permitting relative longitudinal shifting of said mandrel structure in one direction and preventing relative longitudinal shifting in the other direction; resiliently deformable packing means on said mandrel structure; normally retracted expansible anchor slip means on said mandrel structure; a housing structure disposed about said body; piston means in said housing structure at one side of said first passage means and connected with said mandrel structure to form a closed chamber therebetween; latch means releasable by fluid pressure supplied through said first passage means enabling movement of said piston means and mandrel structure by the pressure of fluid supplied through said first passage means; said housing and said body defining a release piston chamber having a release piston between said second and third passage means; release means in said body providing a low pressure chamber and a member shiftable from one position at which said second and third passage means are in communication between the interior of said body and said release piston chamber to another position at which said third passage means communicates with said low pressure chamber; and releasable means on said body engageable by said piston to release said body for movement relative to said mandrel structure to release said packing means and said slip means.

17. A packer as defined in claim 16; said releasable means being a shearable member engaged by said release piston.

18. A packer as defined in claim 16; said release means including means removably supporting it in said body, and means connectable to a running tool to removably dispose said release means in said body.

19. A packer as defined in claim 16; including hold-down means on said mandrel structure having casing engaging anchor members responsive to pressure between said body and said mandrel structure to anchor the packer in the casing.

20. A packer as defined in claim 16; including means for closing off said body to enable pressurization of fluid in said body at said passage means.

* * * * *